United States Patent [19]

Tanozaki et al.

[11] Patent Number: 4,934,326

[45] Date of Patent: Jun. 19, 1990

[54] FUEL INJECTION RATE CONTROL APPARATUS FOR V-ENGINE

[75] Inventors: Tsuneo Tanozaki; Yukio Yamamoto, both of Tochigi; Chuukichi Nihei, Ibaraki; Katsuya Fujimoto; Mitsuru Ueno, both of Tochigi, all of Japan

[73] Assignee: Kabushiki Kaisha Komatsu Seisakusho, Tokyo, Japan

[21] Appl. No.: 315,783

[22] PCT Filed: Jun. 17, 1988

[86] PCT No.: PCT/JP88/00606

§ 371 Date: Mar. 13, 1989

§ 102(e) Date: Mar. 13, 1989

[87] PCT Pub. No.: WO88/10364

PCT Pub. Date: Dec. 29, 1988

[30] Foreign Application Priority Data

Jun. 18, 1987 [JP] Japan ..... 62-092851[U]

[51] Int. Cl.[5] ..... F02M 39/00

[52] U.S. Cl. ..... 123/373; 123/364

[58] Field of Search ..... 123/373, 364, 398, 320, 123/371

[56] References Cited

U.S. PATENT DOCUMENTS

| | | | |
|---|---|---|---|
| 1,158,000 | 10/1915 | Moreton | 123/373 |
| 3,934,568 | 1/1976 | Malyshev et al. | 123/373 |
| 4,091,785 | 5/1978 | Montgomery | 123/373 |
| 4,150,650 | 4/1979 | Tsumura | 123/373 |
| 4,813,389 | 3/1989 | Elsbett | 123/373 |

FOREIGN PATENT DOCUMENTS

| | | | |
|---|---|---|---|
| 715449 | 12/1941 | Fed. Rep. of Germany | 123/373 |
| 903182 | 9/1945 | France | 123/373 |
| 1189508 | 10/1959 | France | 123/373 |
| 1200960 | 12/1959 | France | 123/373 |
| 51-21231 | 6/1976 | Japan . | |
| 58-34272 | 8/1983 | Japan . | |

*Primary Examiner*—Carl Stuart Miller

*Attorney, Agent, or Firm*—Ronald P. Kananen

[57] ABSTRACT

A fuel injection rate control apparatus for a V-engine, formed so that the rational speed of the engine can be prevented from varying when the engine is inclined forward or backward, even if a commonly mass-produced inexpensive governer is used. This control apparatus has a fuel injection pump (1) provided with a governer (2) and mounted on one side portion of a cylinder block, a governer-free fuel injection pump (1') mounted on the other side portion of the cylinder block, and a link mechanism consisting of a connecting shaft ($4_1$) provided in front of the two fuel injection pumps so that the connecting shaft can be turned freely so as to transmit the movement of a rack rod (3) of the governer-carrying fuel injection pump (1) to a rack rod (3) of the other fuel injection pump (1'), a pair of levers ($4_{2\text{-}1}$, $4_{2\text{-}2}$) fixed to both sides of the connecting shaft so as to project in the opposite directions, and a pair of links ($4_3$) connecting these levers and two rack rods together.

2 Claims, 2 Drawing Sheets

FUEL INJECTION RATE CONTROL APPARATUS FOR V-ENGINE

TECHNICAL FIELD OF THE INVENTION

The present invention relates to a fuel injection rate control apparatus for a V-engine and, more particularly, to a fuel injection rate control apparatus for a V-engine having a pair of fuel injection pumps for the respective banks on both sides of a cylinder block, the control apparatus having a link mechanism which secures a predetermined rotational speed whether the engine is inclined forward or backward.

BACKGROUND ART OF THE INVENTION

Conventionally, a pair of fuel injection pump bodies are mounted on both sides of the cylinder block of a V-engine such that when both rack rods move in the same direction, the same function is displayed. One of the fuel injection pumps is provided with a governor, while the other fuel injection pump has no governor, and the movement of the rack rod of the fuel injection pump provided with the governor is transmitted to the rack rod of the fuel injection pump having no governor through a link mechanism. That is, a link mechanism such as that shown in FIG. 1 is widely used.

In FIG. 1, the symbols a and a' both represent a fuel injection pump. The fuel injection pump a' is mounted in the state in which it faces the same direction as the fuel injection pump a. In other words, both fuel injection pumps a and a' are mounted such that when the respective rack rods c move in the same direction, the same function is displayed. The symbol b represents a pump governor which is mounted on the fuel injection pump a so as to control the fuel injection rate by moving the rack rod c of the fuel injection pump a in correspondence with the change of the engine load. Since no governor is mounted on the fuel injection pump a', the movement of the rack rod c of the fuel injection pump a is transmitted to the rack rod c of the fuel injection pump a' by a link mechanism composed of levers $d_{2-1}$ and $d_{2-2}$ which are fixed to a connecting shaft $d_1$ in such a manner as to project in the same direction from both sides thereof and a link $d_3$.

The above-described conventional control apparatus is disadvantageous in that when the engine is inclined forward, the rotational speed of the engine is increased because the levers $d_{2-1}$ and $d_{2-2}$ are moved in the direction of increasing the fuel under the weights of their own gravities, while the rotational speed of the engine is reduced when it is inclined backward.

SUMMARY OF THE INVENTION

Accordingly, it is an object of the present invention to eliminate the above-described problems in the prior art and to provide a fuel injection rate control apparatus for a V-engine in which a pair of levers which are conventionally fixed to a connection shaft as members of a link mechanism in such a manner as to project in the same direction from both sides of the connection shaft are fixed thereto in such a manner as to project in the opposite directions to each other with respect to the connecting shaft, thereby cancelling the weights of the levers whether the engine is inclined forward or backward so that either state of the engine does not exert any influence on the rack rods. When the levers are attached in the directions symmetrical to each other in this way, the right and left levers move in the opposite directions, so that it is possible to control the fuel injection rate without any trouble even if the right and left fuel injection pumps are mounted in the opposite directions to each other and the governor used may be a commonly mass-produced inexpensive governor.

To achieve this aim, the present invention provides a fuel injection rate control apparatus for a V-engine including a fuel injection pump provided with a governor and mounted on one side of a cylinder block, and a fuel injection pump having no governor which is mounted on the other side of the cylinder block, characterized in that a link mechanism is provided which is composed of a connecting shaft rotatably provided in front of the two fuel injection pumps so as to transmit the movement of a rack rod of the governor-carrying fuel injection pump to the rack rod of the fuel injection pump having no governor, a pair of levers fixed to both sides of the connecting shaft so as to project in the opposite directions to each other with respect to the connecting shaft and a pair of links connecting these levers and the two rack rods together, so that the rack rods do not move under the weights of the levers which are fixed to both sides of the connecting shaft even if the engine is inclined forward or backward.

The fuel injection rate control apparatus is characterized in that the fuel injection pump provided with the governor is so controlled as to increase the fuel injection rate when the rack rod is projected and decrease it when the rack rod is contracted, while the fuel injection pump having no governor is so controlled as to decrease the fuel injection rate when the rack rod is projected and increase it when the rack rod is contracted.

The above and other advantages, features and objects of the invention will be apparent to those who are skilled in the art from the following description of the preferred embodiment thereof, taken in conjunction with the accompanying drawings.

BEST MODE FOR CARRYING OUT THE INVENTION

Figure 1:
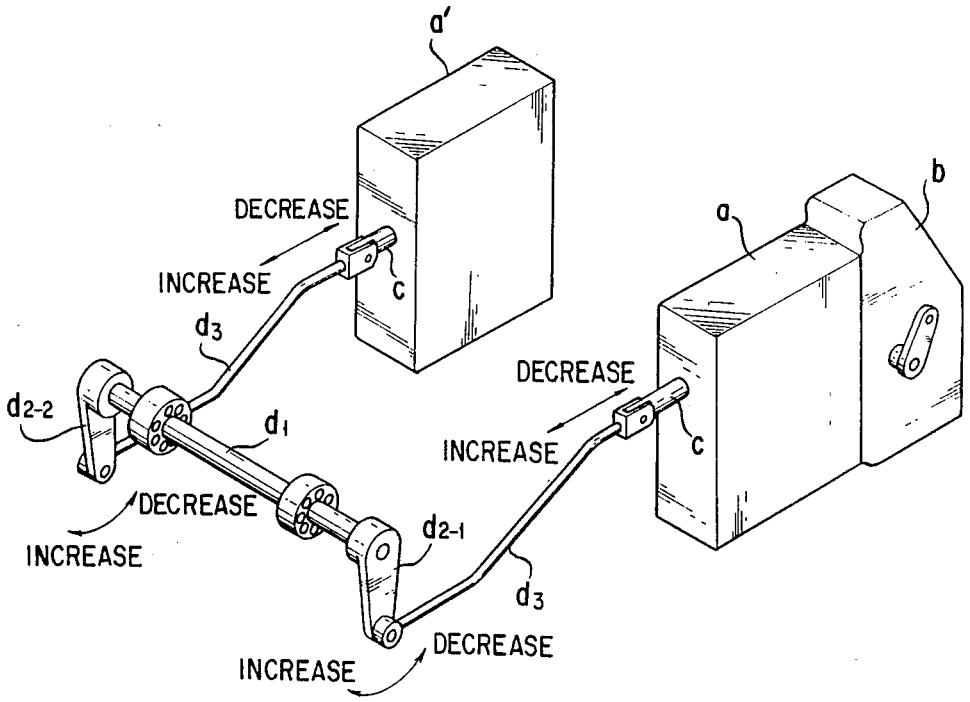
FIG. 1 PRIOR ART
FIG. 1 is a schematic perspective view of a conventional fuel injection rate control apparatus for a V-engine.
Figure 2:
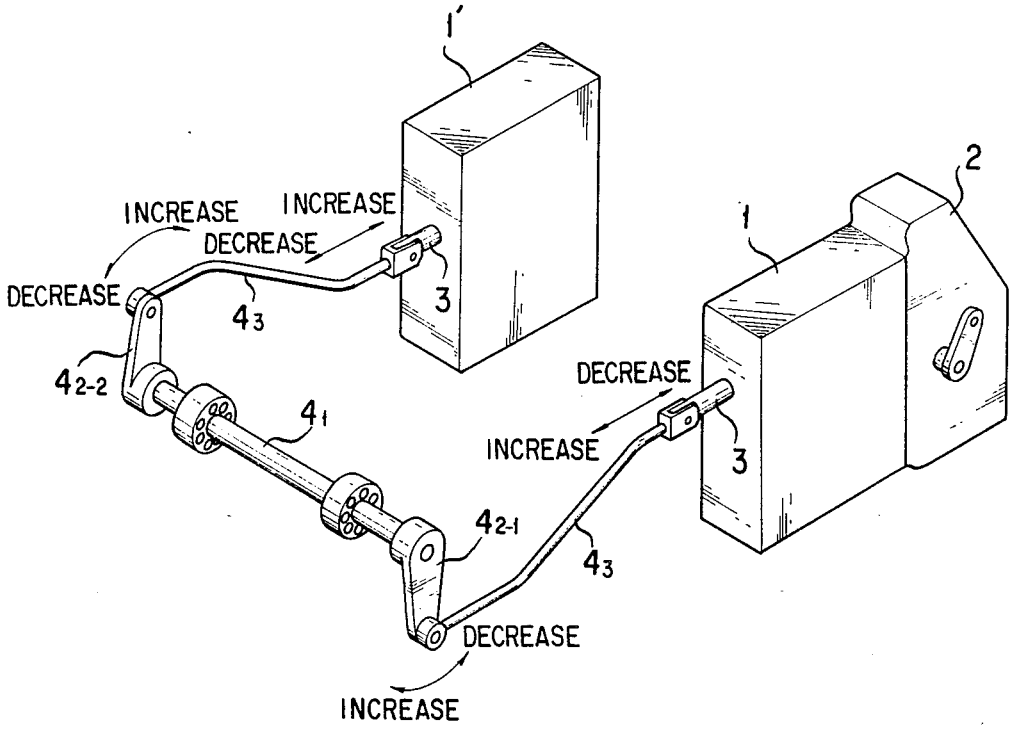
FIG. 2 is a schematic perspective view of an embodiment a fuel injection rate control apparatus for a V-engine according to the present invention.

An embodiment of the present invention will be explained with reference to the accompanying drawings. FIG. 2 is a perspective view of an embodiment of the present invention. In FIG. 2, the reference numerals 1 and 1' both represent a fuel injection pump. The fuel injection pumps 1 and 1' are mounted on the respective sides of a cylinder block (not shown) in the state in which both pumps face in opposite directions to each other. In other words, when the respective rack rods c move in the opposite directions, the same function is displayed.

The reference numeral 2 represents a governor, which is a commonly mass-produced inexpensive one, and which is mounted on one fuel injection pump 1 so as to control the fuel injection rate by moving a rack rod 3 of the fuel injection pump 1 in correspondence with the engine load.

Since the other fuel injection pump 1' is not provided with the governor 2, a link mechanism 4 is provided which is composed of a connecting shaft $4_1$ rotatably provided in front of both fuel injection pumps 1 and 1', a pair of levers $4_{2\text{-}1}$ and $4_{2\text{-}2}$ fixed to both sides of the connecting shaft $4_1$ so as to project in the opposite directions to each other with respect to the connecting shaft $4_1$ and links $4_3$ connecting these levers $4_{2\text{-}1}$ and $4_{2\text{-}2}$ and the rack rods of the respective fuel injection pumps 1 and 1' together, so that the movement of the rack rod 3 of the fuel injection pump 1 provided with the governor is transmitted to the rack rod 3 of the fuel injection pump 1' having no governor so as to control the fuel injection pump 1'.

Since the levers $4_{2\text{-}1}$ and $4_{2\text{-}2}$ are fixed to both sides of the connecting shaft $4_1$ so as to project in the opposite directions to each other with respect to the connecting shaft $4_1$, their own weights are cancelled by each other. Therefore, the weights of the levers $4_{2\text{-}1}$ and; $4_{2\text{-}2}$ do not influence the movement of the rack rods 3 whether the engine is inclined forward or backward and the rotational speed of the engine is not varied whether the engine is inclined forward or backward. Thus, it is possible to constitute a fuel injection rate control apparatus for a V-engine which does not vary the rotational speed of the engine whether the engine is inclined forward or backward even by using a commonly mass-produced inexpensive governor.

We claim:

1. A fuel injection rate control apparatus for a V-engine including a fuel injection pump provided with a governor and mounted on one side of a cylinder block, and a fuel injection pump having no governor which is mounted on the other side of said cylinder block, characterized in that a link mechanism is provided which is composed of a connecting shaft rotatably provided in front of the two fuel injection pumps so as to transmit the movement of a rack rod of said fuel injection pump provided with said governor to the rack rod of the fuel injection pump having no governor, a pair of levers fixed to opposite ends of said connecting shaft so as to project in the opposite directions to each other with respect to said connecting shaft and a pair of links connecting said levers and the two rack rods together, so that said rack rods do not move under the weights of said levers which are fixed to the opposite ends of said connecting shaft even if said engine is inclined forward or backward.

2. A fuel injection rate control apparatus for a V-engine according to claim 1, further characterized in that said fuel injection pump provided with said governor is so controlled as to increase the fuel injection rate when said rack rod thereof is projected and decrease said fuel injection rate when said rack rod is contracted, while said fuel injection pump having no governor is so controlled as to decrease said fuel injection rate when said rack rod thereof is projected and increase said fuel injection rod when said rack rod is contracted.

* * * * *